US010485358B2

(12) United States Patent
Havell et al.

(10) Patent No.: US 10,485,358 B2
(45) Date of Patent: Nov. 26, 2019

(54) SYSTEMS AND METHODS FOR SIMULTANEOUSLY CONTROLLING CINEMA SEATS

(71) Applicant: Theatre FX, LLC, Murray, UT (US)

(72) Inventors: David J. Havell, Salt Lake City, UT (US); Ken Barton, Sandy, UT (US); Aaron Best, Murray, UT (US); Alex Ferro, West Jordan, UT (US); Tim Hayford, Salt Lake City, UT (US)

(73) Assignee: Theatre FX, LLC, Murray, UT (US)

( * ) Notice: Subject to any disclaimer, the term of this patent is extended or adjusted under 35 U.S.C. 154(b) by 0 days.

(21) Appl. No.: 15/923,955

(22) Filed: Mar. 16, 2018

(65) Prior Publication Data

US 2018/0279797 A1 Oct. 4, 2018

Related U.S. Application Data

(60) Provisional application No. 62/477,988, filed on Mar. 28, 2017.

(51) Int. Cl.

| | |
|---|---|
| ***A47C 31/00*** | (2006.01) |
| ***A47C 1/124*** | (2006.01) |
| ***A63J 25/00*** | (2009.01) |
| ***A47C 7/50*** | (2006.01) |
| ***A47C 1/024*** | (2006.01) |
| ***A63J 5/00*** | (2006.01) |
| ***A47C 1/034*** | (2006.01) |
| *A63G 31/00* | (2006.01) |

(52) U.S. Cl.

CPC ..... *A47C 31/008* (2013.01); *A47C 1/0242* (2013.01); *A47C 1/0345* (2013.01); *A47C 1/124* (2013.01); *A47C 7/506* (2013.01); *A47C 7/5068* (2018.08); *A63J 5/00* (2013.01); *A63J 25/00* (2013.01); *A63J 2005/002* (2013.01)

(58) Field of Classification Search

CPC ..... A63G 31/00; A63G 31/16; G09B 19/00; G09B 19/16; G09B 9/00; G09B 9/08; A47C 1/0242; A47C 1/034; A47C 17/163; A47C 31/008

USPC ..... 472/59–61, 130; 434/29, 55; 297/68, 83, 297/85 M, 88

See application file for complete search history.

(56) References Cited

U.S. PATENT DOCUMENTS

| | | | | |
|---|---|---|---|---|
| 4,879,849 | A * | 11/1989 | Hollingsworth, III .. | A63J 25/00 52/10 |
| 6,024,647 | A * | 2/2000 | Bennett ..... | A63G 31/16 472/43 |
| 6,731,088 | B2 * | 5/2004 | Nivet ..... | B60N 2/0244 318/548 |
| 6,733,293 | B2 * | 5/2004 | Baker ..... | G09B 9/08 434/55 |
| 2008/0197677 | A1 * | 8/2008 | Nivet ..... | B60N 2/0244 297/68 |

(Continued)

*Primary Examiner* — Kien T Nguyen

(74) *Attorney, Agent, or Firm* — Michael F. Krieger; Kirton McConkie

(57) ABSTRACT

This invention relates to theater seating, and more particularly to simultaneously controlling a plurality of seats in a theater comprising a user interface and transmitter that can be used to control various elements of the seat, and a receiver and motor control unit attached to each theater seat. In some embodiments, a signal transmitter operated by an individual at a theater may simultaneously control the various elements of any group of seats.

5 Claims, 6 Drawing Sheets

(56) References Cited

U.S. PATENT DOCUMENTS

| | | | | |
|---|---|---|---|---|
| 2015/0026890 | A1* | 1/2015 | Hille | A47C 20/041 5/613 |
| 2015/0076891 | A1* | 3/2015 | LaPointe | A47C 31/008 297/85 M |

* cited by examiner

SYSTEMS AND METHODS FOR SIMULTANEOUSLY CONTROLLING CINEMA SEATS

CROSS-REFERENCE TO RELATED APPLICATIONS

This application claims priority benefit to U.S. Provisional Patent Application No. 62/477,988 which was filed on Mar. 28, 2017.

BACKGROUND

1. Field of the Invention

This invention relates to theater seating, and more particularly to simultaneously controlling a plurality of seats in a theater comprising a user interface and transmitter that can be used to control various elements of the seat, and a receiver and motor control unit attached to each theater seat.

2. Related Art

Electrically powered reclining theater seats are being installed and used in home theater and larger commercial theater environments. Electrically powered reclining theater seats must be individually controlled. While providing an increase in comfort, such seats have become a liability in regards to cleaning the theater. For example, in a typical movie theater the cleaning crew only has a few minutes to sweep the floor of the entire theater before the next wave of viewers are allowed to enter the theater. If all of the seats in a particular theater were electrically powered reclining theater seats, it would take that individual substantially longer to move each seat into a reclined position independently, then back to a fully closed and upright position in the amount of time allowed to clean the theater. Further, the reclined seat may have a back recline feature and/or a seat extension feature. Each of these features is often individually controlled from one seat. The independent nature of the control systems for the individual chairs presents a challenge for cleaning crews assigned to clean a theater between show times. Accordingly, while such theater seats provide increased comfort for individuals watching the movie, they also present challenges that were not present when traditional theater seats were utilized in larger commercial theaters.

BRIEF SUMMARY

This invention relates to theater seating, and more particularly to simultaneously controlling a plurality of seats in a theater comprising a user interface and transmitter that can be used to control various elements of the seat, and a receiver and motor control unit attached to each theater seat.

Some embodiments comprise a wireless remote control for powered theater recliners and are used to recline the seats into an open position to allow for ease of cleaning. According to some embodiments, a system for controlling a plurality of seats in a theater is used to place the recliners back into an upright closed or folded position after cleaning has been completed. Some embodiments comprise an electronically powered remote control that communicates to the powered theater seats over a radio frequency (RF). The remote control may be utilized to send commands to the seats to recline or go to the upright, closed or home position.

The reclined seat may have a back recline feature and/or a seat extension feature or more features.

According to some embodiments a person in a theater's general location with the remote control may need the seats to be returned to the home position or any other position before the start of each performance. By pushing the appropriate button on the remote, all of the seats that are paired with the remote will be returned to the home or starting position.

BRIEF DESCRIPTION OF THE DRAWINGS

The specific features, aspects and advantages of the present invention will become better understood with regard to the following description and accompanying drawings where.

DETAILED DESCRIPTION

This invention relates to theater seating, and more particularly to simultaneously controlling a plurality of seats in a theater comprising a user interface and transmitter that can be used to control various elements of the seat, and a receiver and motor control unit attached to each theater seat.

Some embodiments comprise a wireless remote control for powered theater recliners and are used to recline the seats into an open position to allow for ease of cleaning. According to some embodiments, a system for controlling a plurality of seats in a theater is used to place the recliners back into a closed upright (home) sitting position after cleaning has been completed. Some embodiments comprise an electronically powered remote control that communicates to the powered theater seats over a radio frequency (RF). The remote control may be utilized to send commands to the seats to recline or go to the home position. The reclined seat may have a back recline feature and/or a seat extension feature or more features.

According to some embodiments a person in a theater's general location with the remote control may need the seats to be returned to the home position or any other position before the start of each performance. By pushing the appropriate button on the remote, all of the seats that are paired with the remote will be returned to the home or starting position.

Figure 1:
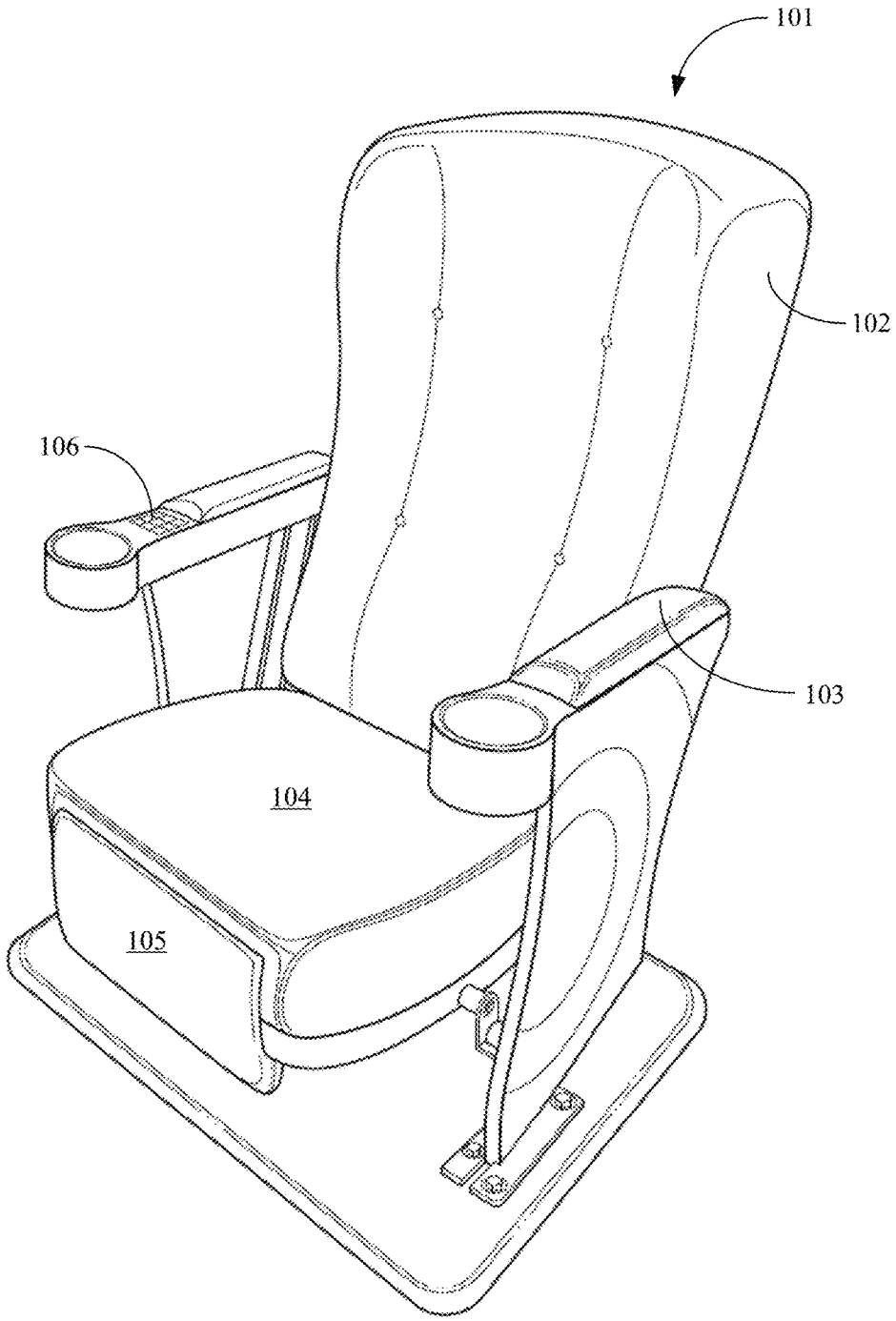
FIG. 1 shows a perspective view of a representative theater seat on a closed position.

FIG. 1 illustrates a perspective view of a reclining theater seat 101 in a closed position. In some embodiments the theater seat comprises a back rest 102, armrest(s) 103, a seat cushion 104, a leg support 105, a user interface 106, and a power supply (not illustrated). FIG. 1 illustrates theater seat 101 in a closed position, wherein the leg support 105 is lowered allowing for individuals utilizing the seat 104 to easily sit down in seat 101, or get up from seat 101.

Figure 2:
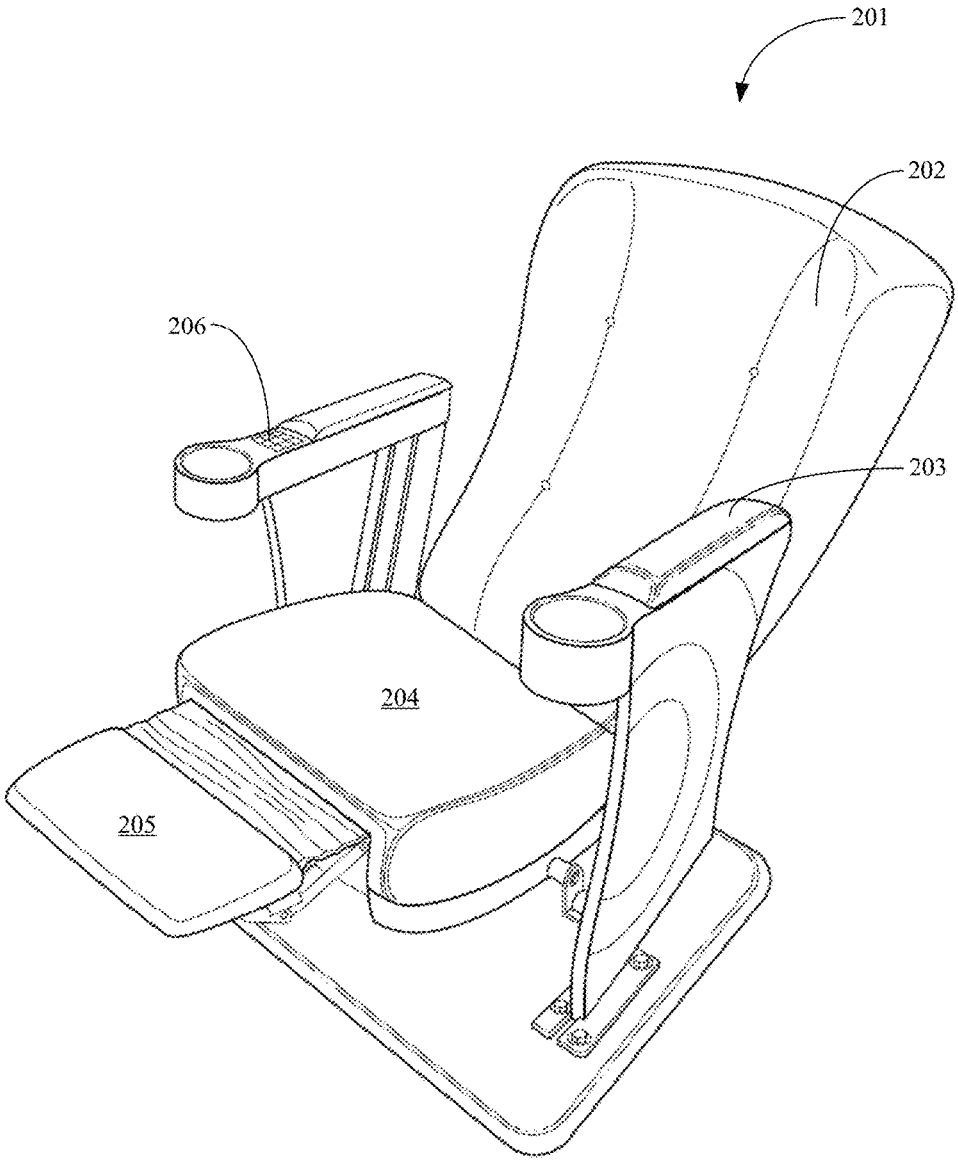
FIG. 2 shows a perspective view of a representative theater seat in an open position.

FIG. 2 illustrates a perspective view of a recliner theater seat 201 in an open position. In some embodiments the theater seat comprises a back rest 202, armrest(s) 203, a seat 204, a leg support 205, a user interface 206, and a power supply (not illustrated). FIG. 2 illustrates the theater seat 201 in an open position, wherein the leg support 205 is raised to support the legs and feet of an individual utilizing seat 201.

Figure 3:
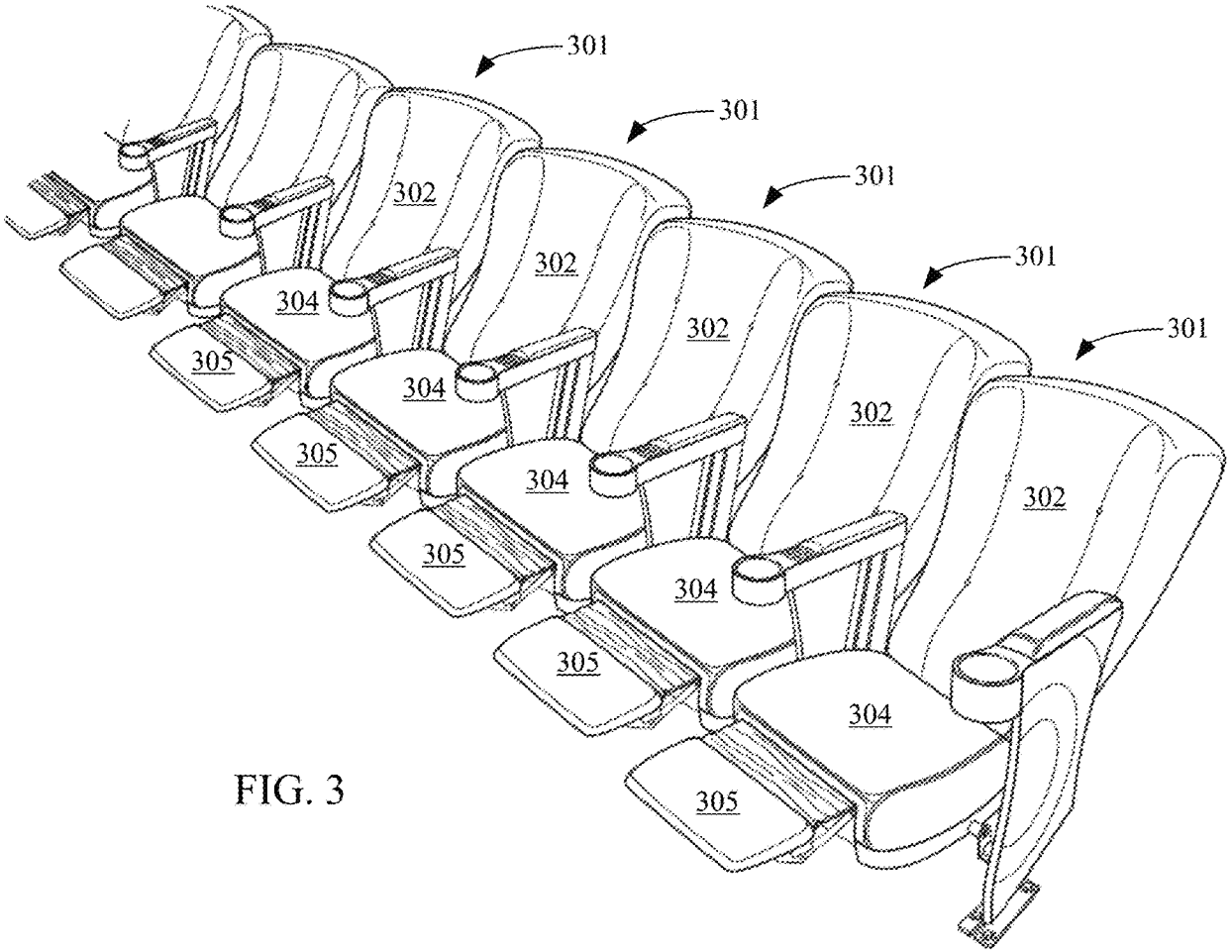
FIG. 3 shows a perspective view of a series of theater seats in an open position.

FIG. 3 illustrates a perspective view of several recliner theater seats 301 in an open position. In some embodiments the theater seats 301 may comprise a back rest 302, armrest(s) 303, a seat cushion 304, a leg support 305, a user interface 306, and a power supply (not illustrated). FIG. 3 illustrates the theater seats 301 in an open position, wherein the leg supports 305 are raised to support the legs and feet of an individual utilizing seat 301.

Figure 4:
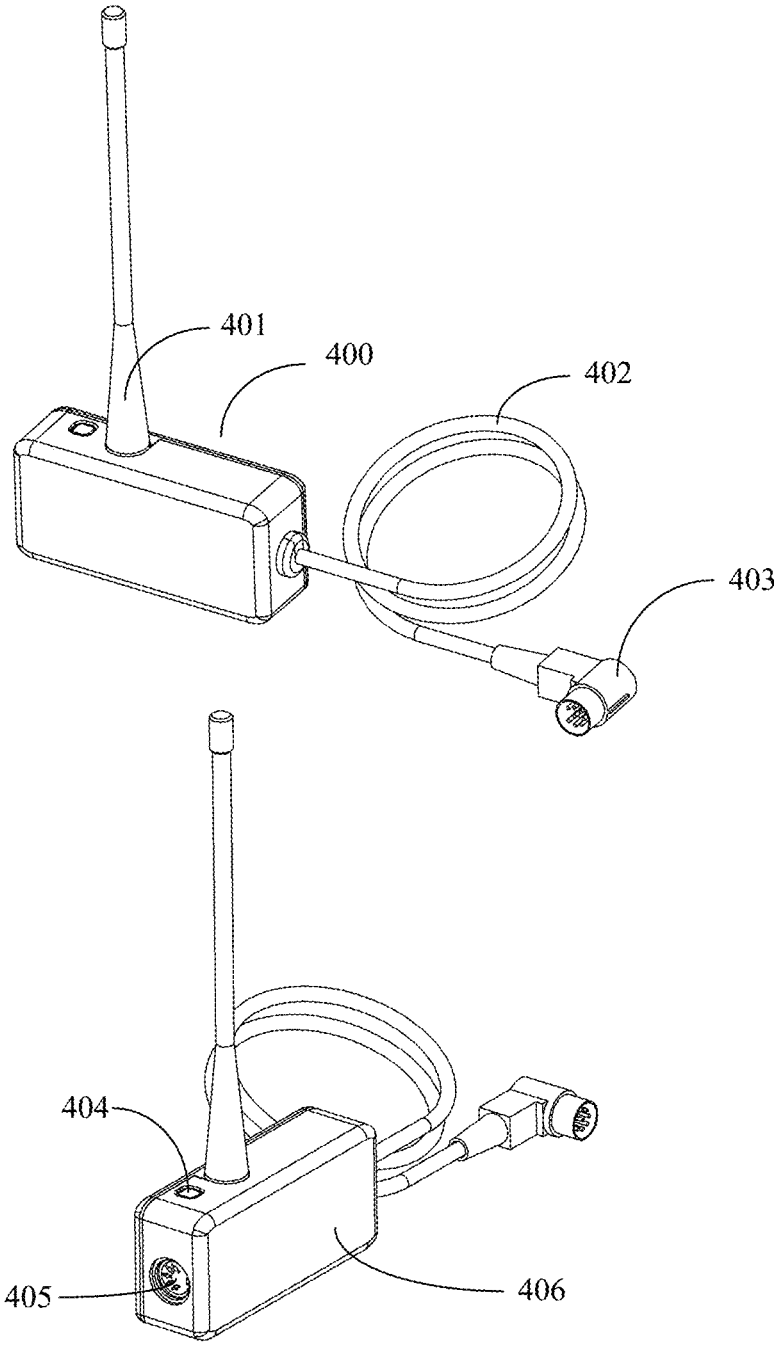
FIG. 4 shows a perspective view of a receiver and motor drive in accordance with some embodiments of the present invention.

FIG. 4 illustrates a perspective view of a receiver and control unit 400 comprising a housing 406 attached to an antennae 401. Connected to housing 406 is a cable 402 and a connector 403. Some embodiments may also comprise a reset switch 404 and an input connector 405.

Figure 5:
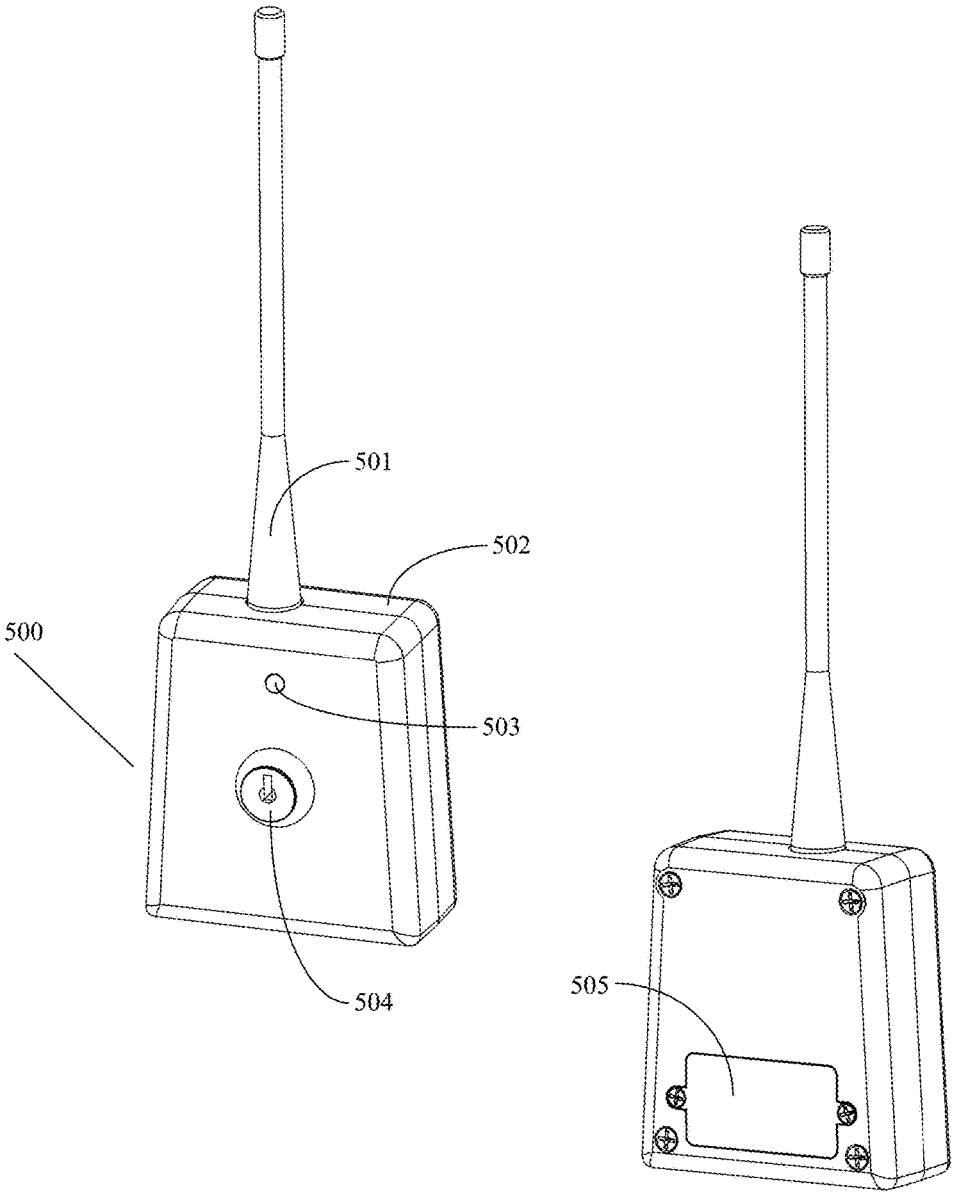
FIG. 5 shows a perspective view of a transmitter in accordance with some embodiments of the invention.

FIG. 5 illustrates a perspective view of a transmitter unit 500. In some embodiments transmitter unit 500 may comprise a housing 502, a switch or button 504, a battery door 505, and an antenna 501. Some embodiments may also comprise an LED indicator 503 to indicate when a transmission is being sent. Transmitter unit 500 may be utilized to send signals to any seat with an attached receiver and control unit.

Figure 6:
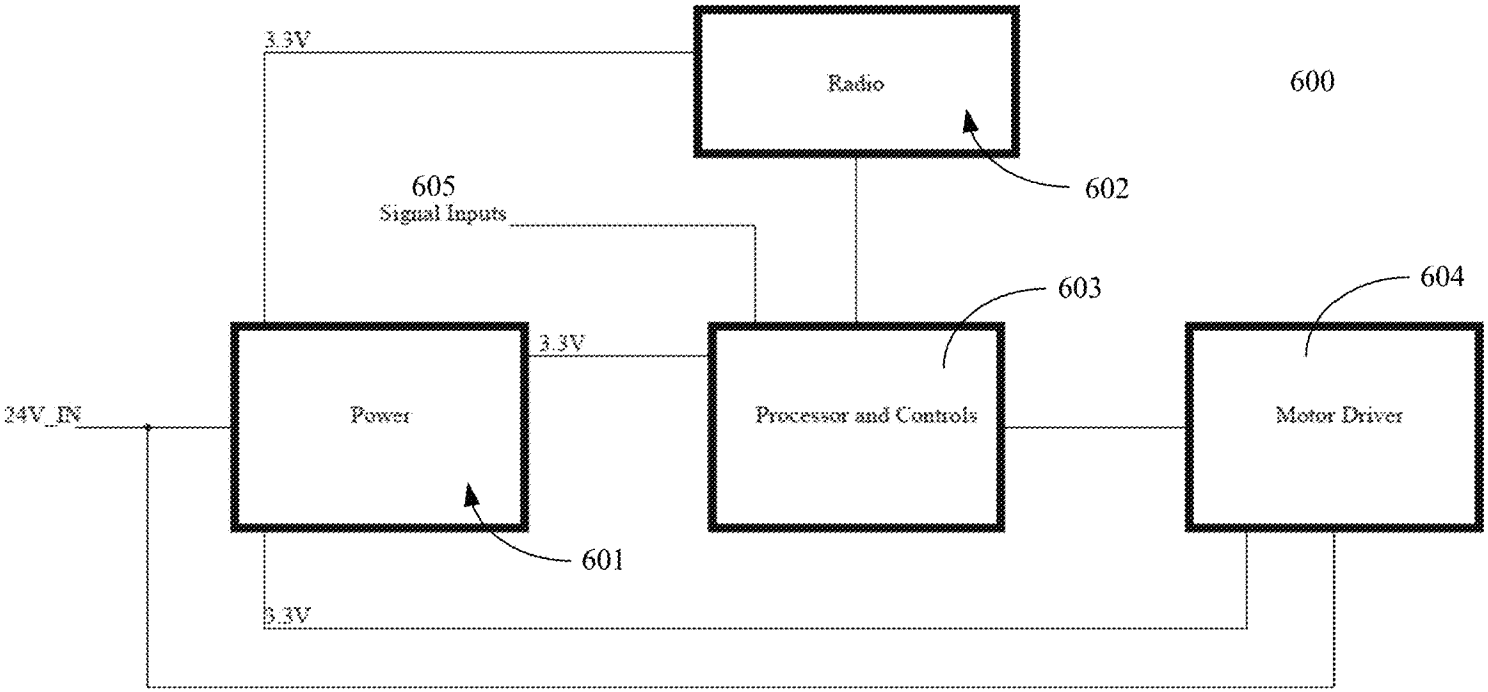
FIG. 6 shows a block diagram of a receiver and motor drive assembly in accordance with some embodiments of the invention.

FIG. 6 illustrates a block diagram of the receiver and control unit 600. The receiver and control unit 600 may comprise a power source 601, processor and controls 603 a radio 602 and motor driver 604. The processor and controller 603 may receive signal inputs 605, and provide the signal for the motor diver 604 to move any of the movable elements of an electrically powered reclining theater seat. For example, the motor may move the leg support 105, 205, 305 into a closed or open/reclined position.

In some embodiments a person may utilize transmitter unit 500 to control all of the theater seats with a receiver and control unit 400 that have been previously linked to the transmitter unit 500. The individual may utilize switch or button 504 to send a signal to the receiver and control unit to put all of the theater seats in a fully upright and closed position, or for all of the theater seats to be moved into a fully reclined or open position. For example, when an individual responsible for cleaning a theater after every showing enters the theater to clean that theater, the individual may utilize a switch or button 504 on the transmitter unit 500 to send a signal to a receiver and control unit 600 attached to each of the chairs in the theater moving them to a fully open or reclined position to allow for cleaning of the entire theater without having to move each seat into an open position independently. Once the cleaning has been completed the individual may again utilize the transmitter 500 to send a signal to the receiver and control unit 400, which then processes the signal from transmitter 400, moving all of the seats to a fully upright and closed position in order to allow the next group of individuals entering the theater to take a seat with the reclining seat in a closed position. In this fashion, an individual may control all of the seats in a theater simultaneously, instead of being required to manual control each of the theater seats independently, allowing for a more complete cleaning of the theater to occur in the small window of time allowed between each showing of a movie in a particular theater.

The foregoing examples are merely examples of potential areas of applicability of certain embodiments of the invention, and other areas of applicability will be understood by way of practicing the embodiments of the invention.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description.

What is claimed:

1. A system for simultaneously controlling multiple reclining theater chairs comprising:

a radio frequency (RF) transmitter unit comprising a key-operated switch or button and a transmitter antenna;

a receiver unit structured to receive a signal from the transmitter unit;

a control unit coupled to the receiver unit and to a motor driver for modifying a recline configuration of an individual theater seat, wherein the receiver comprises a radio unit for receiving a signal from the transmitter, a processor and control module structured to assimilate the received signal into motor instructions to be sent to the motor driver to change the configuration of the theater seat between a first configuration in which a leg support is fully raised and a second configuration in which the leg support is lowered.

2. The system of claim 1, wherein changing the configuration of the theater seat comprises moving a footrest and a backrest relative to a seat cushion.

3. The system of claim 1, wherein the control unit is structured to move a theater seat to a fully open or a reclined position.

4. The system of claim 1, wherein the control unit is structured to move a theater seat to a fully closed or upright position.

5. The system of claim 1, wherein the transmitter is linked to multiple receiver units inside of the same theater, structured to allow multiple seats in the theater to receive the same signal from the transmitter and provide appropriate signals to the control and motor drivers to execute the same instructions on several theater seats simultaneously.

* * * * *